United States Patent [19]

Vöhringer

[11] Patent Number: 5,074,339

[45] Date of Patent: Dec. 24, 1991

[54] DOUBLE LAYERED PAPER MAKING FORMING FABRIC WITH A COARSE STRUCTURED RUNNING SIDE AND A FINE STRUCTURED PAPER SIDE

[75] Inventor: Fritz Vöhringer, Heidenheim, Fed. Rep. of Germany

[73] Assignee: Oberdorfer GmbH & Co. KG Industriegewebe-Technik, Fed. Rep. of Germany

[21] Appl. No.: 265,452

[22] PCT Filed: Sep. 16, 1987

[86] PCT No.: PCT/EP87/00531

§ 371 Date: Oct. 28, 1988

§ 102(e) Date: Oct. 28, 1988

[87] PCT Pub. No.: WO88/02797

PCT Pub. Date: Apr. 21, 1988

[30] Foreign Application Priority Data

Oct. 14, 1986 [DE] Fed. Rep. of Germany ..... 3635000

[51] Int. Cl.[5] ..... D21F 1/10; D03D 13/00

[52] U.S. Cl. ..... 139/383 A; 162/348; 162/DIG. 1

[58] Field of Search ..... 162/DIG. 1, 348, 358; 139/383 A, 425 A, 410, 413

[56] References Cited

U.S. PATENT DOCUMENTS

| | | | |
|---|---|---|---|
| 3,851,681 | 12/1974 | Egan | 167/DIG. 1 |
| 4,231,401 | 11/1980 | Matuska | 162/DIG. 1 |
| 4,394,414 | 6/1990 | Borel | 139/383 A |
| 4,564,052 | 1/1986 | Borel | 162/DIG. 1 |
| 4,592,396 | 6/1986 | Borel et al. | 162/DIG. 1 |
| 4,636,426 | 1/1987 | Fleischer | 162/DIG. 1 |
| 4,789,009 | 12/1988 | Troughton | 139/383 A |

FOREIGN PATENT DOCUMENTS

| | | | |
|---|---|---|---|
| 185177 | 10/1985 | European Pat. Off. . | |
| 484742 | 5/1938 | United Kingdom | 139/425 A |

*Primary Examiner*—Karen M. Hastings
*Assistant Examiner*—Laura L. Miles
*Attorney, Agent, or Firm*—Gifford, Groh, Sprinkle, Patmore and Anderson

[57] ABSTRACT

The invention relates to a double layered paper making forming fabric with a coarse structured running side and a fine structured paper side comprising a longitudinal thread set (yarns in machine direction) and at least two transverse thread sets (yarns in cross-machine direction), which are interwoven in an at least six shaft pattern repeat, so that a transverse thread set forms on the running side a preceding plane of wear and the remaining transverse threads or transverse thread sets are arranged on the paper side or paper making surface and may differ from each other with respect to the diameter material and/or length of the floatings. For modern, quick and efficient but also more sensitive printing processes papers of the highest qualities are required. An optimization of the above called quality features has however not been achieved as yet with double layered forming fabrics. The double layered paper making forming fabric is therefore to be developed further in such a way that this paper making forming fabric satisfies highest requirements with respect to fine meshes on the paper side, coarse meshes on the running side and wear resistance. This object is achieved by the fact that at least parts of the transverse threads on the running side from multiple threads each consisting of at least two closely adjacent or contiguous threads which are bound by different longitudinal threads.

10 Claims, 4 Drawing Sheets

DOUBLE LAYERED PAPER MAKING FORMING FABRIC WITH A COARSE STRUCTURED RUNNING SIDE AND A FINE STRUCTURED PAPER SIDE

BACKGROUND OF THE INVENTION

The invention relates to a double layered paper making forming fabric with a coarse structured running side and a fine structured paper side.

Since long time the paper makers request that in the manufacturing of paper making forming fabrics the paper side, i.e. the paper making surface of the paper making forming fabric, should be provided with an as small meshed structure as possible to obtain an optimal fiber depository at a high as possible retention and a complete absence of marking, while the running side of the paper making forming fabric should be provided with coarse meshes to achieve a good dewatering of the pulp, whereby furthermore the susceptibility to pollution should be reduced and the cleaning possibilities should be improved. Additionally the running side should be sufficiently wear resistant by respective built-in-materials, so that at least the life time usual nowadays for double layered forming fabrics is achieved.

For the attainment of the above quality features of double layered paper making forming fabrics considerable progresses have been made in the last years, but no fabrics could have been manufactured which are adequate in their entirety to the modern, quick and efficient but also more sensitive printing processes to that extent that they can deliver papers of highest quality. Even the so-called composite forming fabrics, comprising two complete fabrics connected to one another could not completely fulfill as yet the requirements of the requested paper qualities.

In this context attention is drawn for instance to U.S. Pat. No. 4,112,982 disclosing two-layered forming fabrics which are characterized by transverse or cross floatings on the paper side and a coarse structure of the running side by means of relatively thick cross threads of a relative low number. The practice has shown in this connection that only cross threads of a similar thickness can be interwoven with the fine longitudinal threads of the known double layered fabric on the running side thereof and that by increasing the diameter of the cross threads the weft runner quality is lost more and more. That means, the distance between the wear plane provided by the cross thread floatings and the plane of the longitudinal thread knuckles is getting less and less. That is the reason why the longitudinal threads are exposed too early to the wearing so that a quick loss of the stability in the longitudinal direction will occur leading finally to a tearing in transverse direction of the fabric and a reduced running time.

SUMMARY OF THE INVENTION

Accordingly, it is the object of the invention to provide a double layered paper making forming fabric of the above-mentioned type having improved sheet support surface smoothness and long service life.

It is another object of the present invention to provide such a papermaker's fabric with fine meshes on the paper side and coarse meshes on the running side and having moreover excellent wear resistance so that over the full service life papers of highest quality can be produced which are highly suited for the modern and sensitive printing processes.

These objects are solved by a double layered paper making forming fabric with a coarse structured running side and a fine structured paper side, comprising a longitudinal thread set and at least two cross thread sets which are interwoven in a weave pattern of at least six shafts, so that a cross thread set forms on the running side a wearing plane and the remaining cross threads or thread sets are arranged on the paper side, and threads of the cross thread sets on the running side may differ from each other with respect to the diameter and/or material of the threads, and the cross threads on the paper side may differ in the length of their floatings, wherein at least some of the cross threads on the running side form multiple threads, each of them consisting of at least two closely adjacent threads which are interlaced by different longitudinal threads. Thus, the basic idea of the invention is to interweave instead of a single thick cross thread which can be formed only with difficulties to knuckles several cross threads which can as single threads more easily be weft to form knuckles. That is the reason why the fabrics or wires according to the invention get nearly the same good qualities as the socalled composite wires but without taking over the disadvantages of the latter ones. Furthermore, the manufacturing of the fabrics according to the invention is less complicate because they are provided with only one system of longitudinal threads and don't require connecting threads.

In those cases, in which according to the invention the strengthening of the running side of the double layered forming fabric is made with the aid of pairs of threads, these pairs of threads can be called "twin threads", which are formed of subsequent transverse running threads being arranged in a small distance with respect to each other and which even touch each other exceptionally. But they do not form double threads, because they are not interlaced with the same longitudinal threads as is the case with the double threads but instead are interlaced with different longitudinal threads.

Twin threads are certainly known in the art, i.e. by U.S. Pat No. 4,231,401. Such known twin threads, however, are until now in this connection recognized only as a negative phenomenon which has to be avoided or eliminated.

The invention which clarifies the background of the weaving mechanic for the twin effect makes it possible to use that effect in a particular extent for the solution of the above-mentioned objects.

Further advantageous embodiments of the invention are directed to the teaching of the weaving technique for forming pairs of weft threads on the running side of the fabric. Both threads of a pair of twin threads are shifted appropriately with respect to each other by n/2 longitudinal threads, in which n is the number of the weave pattern and in which both longitudinal threads which are interlaced with one of the two threads of a pair of twin threads respectively, are advantageously interwoven with the remaining cross threads in the same manner within the weave pattern with the exception of the twin threads theirselves. Therefore, the arrangement of the interlacing points of the cross threads on the running side within the complete weave pattern consisting of two weave pattern parts is subject of a particular embodiment in which the arrangement of the longitudinal and transverse knuckles on the paper forming side in the said weave pattern parts is the same.

The fact that in these advantageous embodiments the structure of the paper forming side is not mentioned, means that the invention can be used normally for any double layered binding patterns.

According to a further advantageous embodiment, the cross thread sets on the paper side are different from each other and are different from the cross thread sets on the running side with respect to the length of their floatings in order to provide a relative open-meshed running side in which as much abrasion material as possible can be built-in while maintaining a very fine meshed paper side. The material and the diameter of the cross threads sets on the paper side may be the same or different.

BRIEF DESCRIPTION OF THE DRAWINGS

A better understanding of the invention will be reached by reference to the following detailed description when read in conjunction with the accompanying drawings in which.

DETAILED DESCRIPTION OF THE PREFERRED EMBODIMENT OF THE INVENTION

For the manufacturing of the paper making forming fabric or wire according to the invention it is advantageous to select at first a useful weave pattern, which is excellently suited for the manufacturing of finest papers. Such a pattern is shown in the FIGS. 1 and 1*a*, in which FIG.1 discloses the paper or forming side of a known double layered forming fabric having 7 shafts and FIG. 1*a* discloses the running side of this fabric. A longitudinal thread set 1 is designated by a, b, c, d, e, f, and g. The cross threads on the forming or paper making side are designated by 2 and the cross threads on the wear side or running side are designated by 3.

Figure 2:
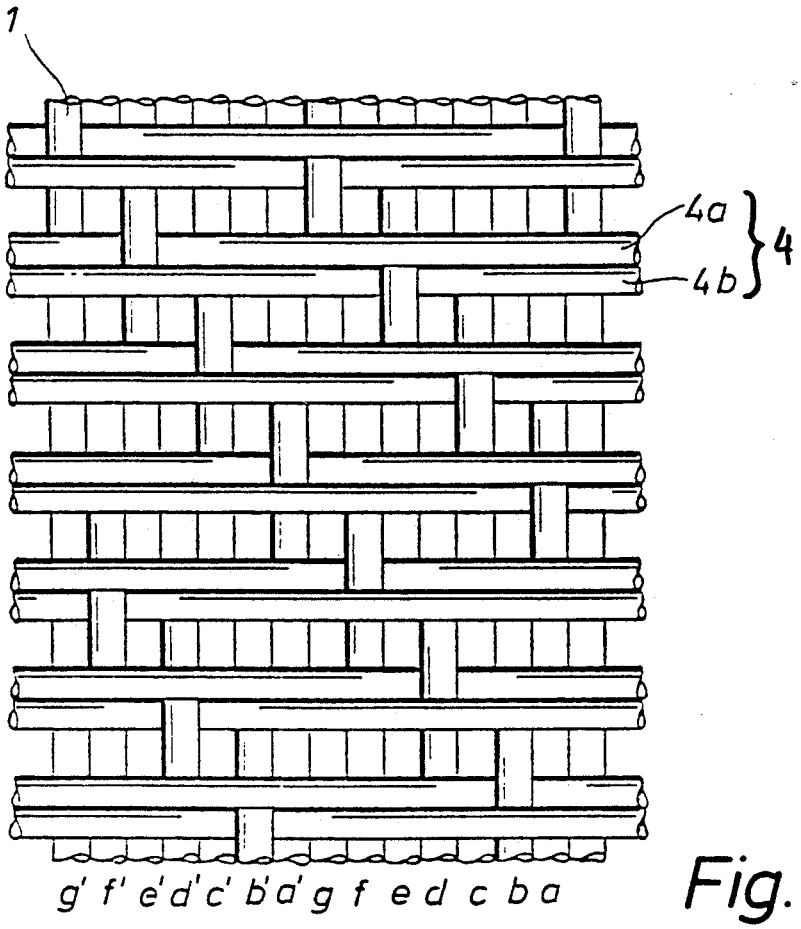
FIG. 2 is a plane view of the running side of a paper making forming fabric according to the invention having 14 shafts (weave pattern repeat number 14), which is provided with so-called twin threads.

As shown in FIG. 2 in that weave pattern, the cross threads 3 on the wear side are replaced by twin threads 4*a*, 4*b*, that means by pairs of threads or yarns consisting of successive cross threads, which in this embodiment are contacting each other and distinguish, as shown, from the known double threads therein that they are not interlaced by the same longitudinal threads but by different longitudinal threads. That is, a given longitudinal thread of the thread set will only pass under one of the two twin threads or pair of threads on the running side.

The forming side, i.e. the paper side, remains unchanged. That means that the fabric side of the embodiment according to FIG. 2 corresponds to the embodiment of FIG. 1, wherein the weave pattern parts g, f, e, d, c, b, a, ... g', e', d', c', b', a' of the fabric of FIG. 2 having 14 shafts differ from each other only with respect to the running side.

By mutual shifting of the single threads 4*a*, 4*b* of a twin pair about n/2 longitudinal threads, wherein "n" is the number of shafts or number of weave pattern repeats, the maximum distance between the interlacing points of the threads of each pair in cross direction is provided so that the repelling or separating force between these threads is reduced to a minimum. The interlacing points of the second thread of a pair of twin threads and of the first thread of the following pair of twin threads however, have always a smaller distance. Therefore, a higher repelling force exists between these two threads. The terminology "repelling force", as used herein, means the resistance, developed by those warp threads, which are crossing themselves behind the last interwoven weft thread in order to interlace this weft thread against the following weft thread, which has to be interlaced. This resistance is higher as the crossing warp threads are positioned closer to one another. This effect of twin forming or formation of pairs of threads will be even increased by the fact that the two longitudinal threads, each of which is interlaced with one of the two threads of a pair of twin threads are interwoven in the same manner with the remaining cross threads, exclusive of the twin threads themselves within the weave pattern repeat. This means that with respect to the running side of the fabric shown in FIG. 2 the single threads 4*a*, 4*b* of a pair of twin threads are interlaced at places of two adjacent pattern parts a, ... g; a', ... g', corresponding to each other. One can also say that the above-mentioned threads are "woven at the same place".

The thus generated twin effect is so strong that in many embodiments of such fabrics the single threads of a pair of twin threads touch each other like double threads. But this is not a necessary condition for reaching the desired above-mentioned aim.

As in two adjacent weave pattern parts the twin threads 4*a*, 4*b* are woven at the same place, the surface of the paper side, i.e. the forming side of the fabric is not disturbed by the twin threads of the running side. Thus, if an original binding is selected having a tendency of providing markings as few as possible then this capacity is also retained in case,as explained above, the cross threads 3 (FIG. 1*a*) on the wear side or running side are replaced by the twin threads 4*a*, 4*b*. It goes without saying that not every cross thread of the elected original binding pattern must be replaced by a pair of twin threads but it is possible to replace as little as every second original cross thread by a pair of twin threads. In that case the remaining cross threads retain their original configuration, but they, on the other hand can also be omitted completely. In this connection reference is made to the embodiment of the forming fabric with the shaft or pattern repeat number 10, shown in FIG. 3. In this embodiment it can easily be seen, that only every second cross thread of the paper side is related to a pair of twin threads 4*a*, 4*b*, because every second original cross thread of the running side of the elected binding pattern is omitted. In contrast to the structure of the fabric as shown in FIG. 2, in this structure of FIG. 3 the position of the longitudinal thread is open. The cross threads of the paper side float over 4 successive longitudinal threads. The points, marked with little circles indicate those places, at which the cross threads located over the twin threads are crossed by a longitudinal thread. The structure of the paper side (forming side) corresponds therefore to that one of a 5 shaft-Atlas fabric. Thus, it is possible, to combine a very fine meshed paper side with a especially coarse meshed running side of the forming fabric.

Figure 4:
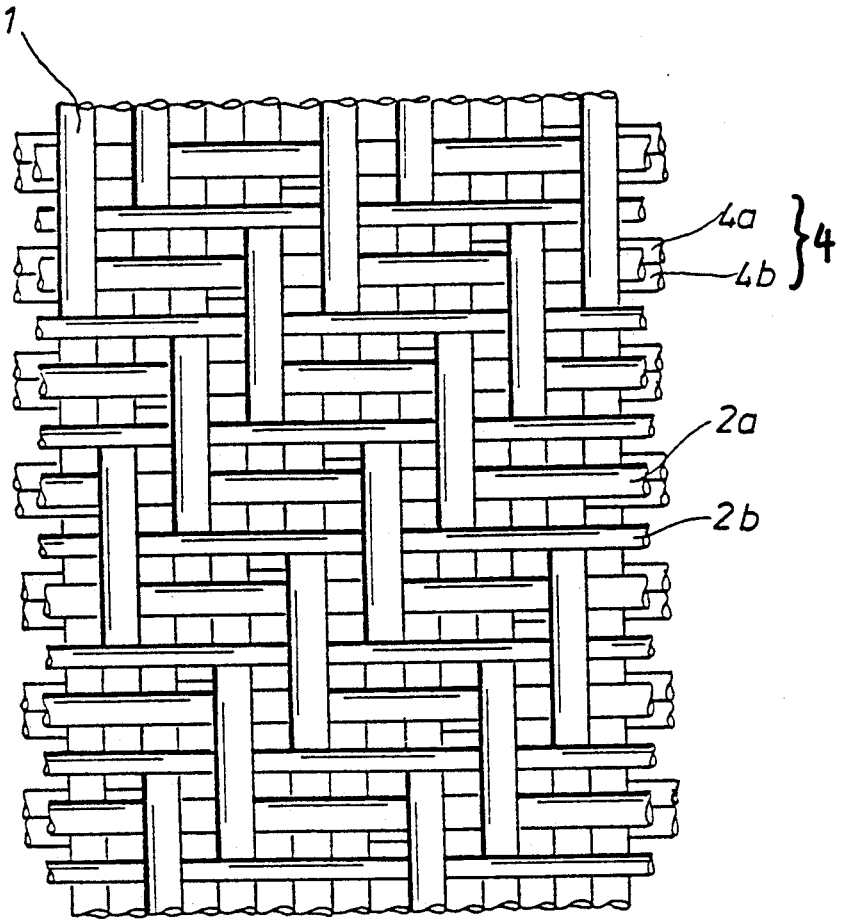
FIG. 4 is a plan view of the paper forming side of a further embodiment of the forming fabric according to the invention in which the twin threads on the running side span 13 longitudinal threads and are arranged as in the embodiment according to FIG. 2.

In the embodiment of the double layered paper making fabric, shown in FIG. 4 as a plane view of the forming side, the floatings of the thick cross threads 2*a* of the paper side are crossing 4 successive longitudinal threads, whereas the thinner cross threads 2*b* of the paper side are crossing 6 successive longitudinal threads. The twin threads 4*a*, 4*b* on the running side or wear side span 13 longitudinal threads. Their arrangement corresponds to the arrangement of the fabric of FIG. 2. In this embodiment the cross thread sets of the paper side are different with respect to their diameters.

In the above described structure of the forming fabric drainage channels are formed having the shape of a reversed funnel. The water of the pulp enters at the small opening (fine meshes) into the funnel and leaves at the big opening (coarse meshes). In this way a very homogenious fiber mat is formed over the small funnel openings w out drawing an essential part of the fibers into the funnel. Because of this the retention of the double layered fabrics according to the invention, i.e. their hold-back ability for fiber material and for the fine substances is greater than with the known fabrics.

A further advantage of double layered fabrics described hereabove consists in that the large funnel openings, which are faced to the dewatering elements of the paper machine for instance the foils and suction elements, facilitate the cleaning of the fabrics and to maintain them clean. In addition to that the tendency of formation of vacuum and of drawing vacuum inclusions into the funnels over the suction coverings is reduced within the increasing size of the funnel openings. Accordingly, the power input and the energy consumption for the drive of the fabric is reduced.

When it has been stated as solution of the above-mentioned problem underlying the invention that at least parts of the cross threads 4*a*, 4*b* of the running side form multiple threads each of them consisting of two closely adjacent threads, which are interlaced by different longitudinal threads, then the term "multiple threads" mean, that not only twin threads are used which are underlying the above embodiments but also thread triplets, thread quadruplets, quintuplets and so on. That means, the teaching of the invention is not limited to the twin threads and therefore to pair of threads consisting of two successive, cross running threads. The above-mentioned so-called twin effect would then appear at the thread triplets, thread quadruplets and so on. Thus one can call it a triplet effect, quadruplet effect and so on.

Figure 3:
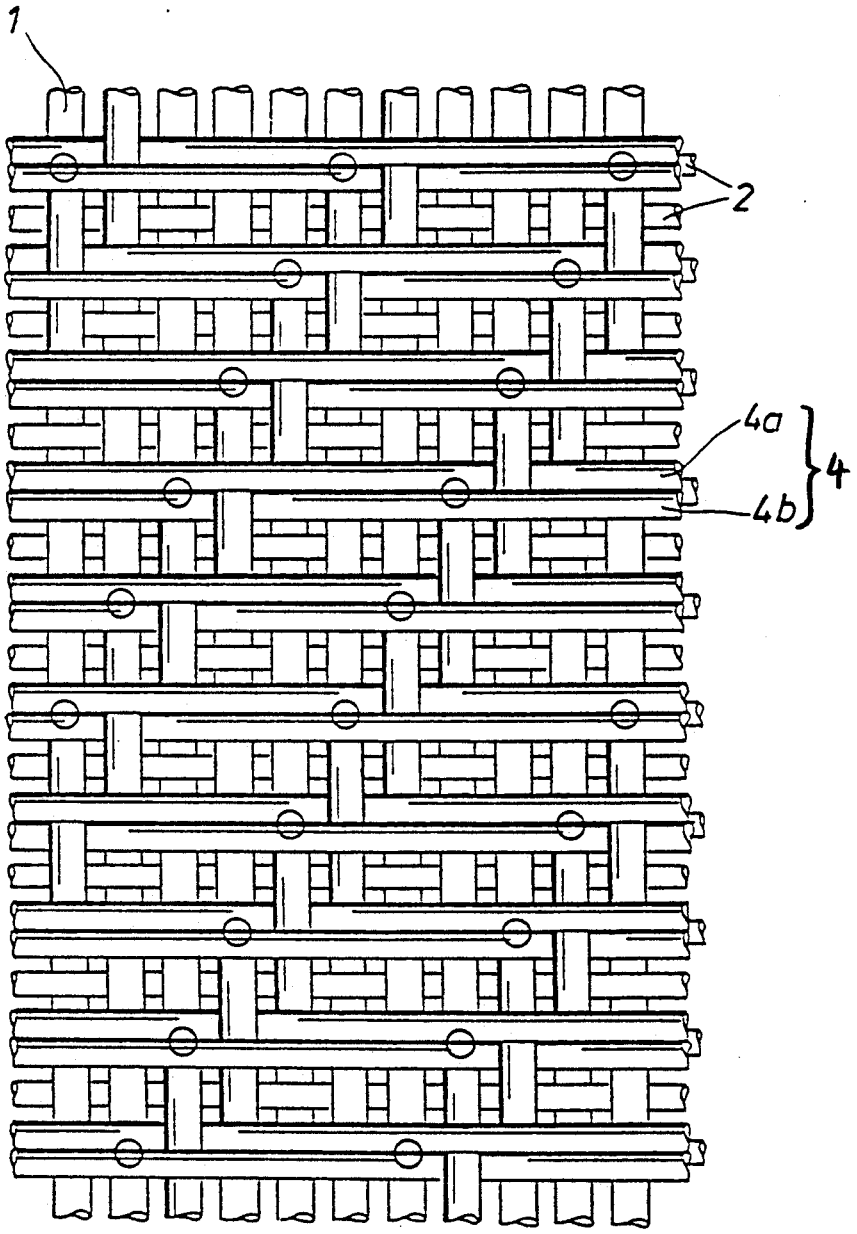
FIG. 3 is a plane view of the running side of a further embodiment of the forming fabric according to the invention having 10 shafts (weave pattern repeat number 10) in which the position of the longitudinal thread is open and the cross threads of the paper side float over 4 successive longitudinal threads.

In the following some examples for wires with twin threads are characterized in more detail with reference to the drawing figures. For example the following dimensions for the 10-shaft binding, shown in FIG. 3, are used:

longitudinal thread number; 24/cm $\phi$ 0.25 mmPES
cross thread number, paper side; 20/cm $\phi$ 0.27 mmPES
cross thread number, running side; 20/cm $\phi$ 0.32 mmPES
$\phi$ = diameter For example the following dimensions for the 14-shaft binding, shown in FIG. 4, which is suited for fine and finest papers, can be used:

longitudinal thread number; 65/cm $\phi$ 0.14 mmPES
1. cross thread number,paper side; 20/cm $\phi$ 0.17 mmPES
2. cross thread number,paper side; 20/cm $\phi$ 0.12 mm/PES
cross thread number,running side; 40/cm $\phi$ 0.18 mmPES/PA (PES = polyester, PA = polyamide)

The interweaving, the so-called yield, i.e. the worked-in warp thread length per fabric length is between 6% and 15% depending upon the used basic binding.

The above described double layered paper making forming fabrics with coarse structured running side and fine structured paper side can be used for the manufacturing of substantially all kinds of papers depending upon the fineness or mesh size and the type of the binding.

Figure 1:
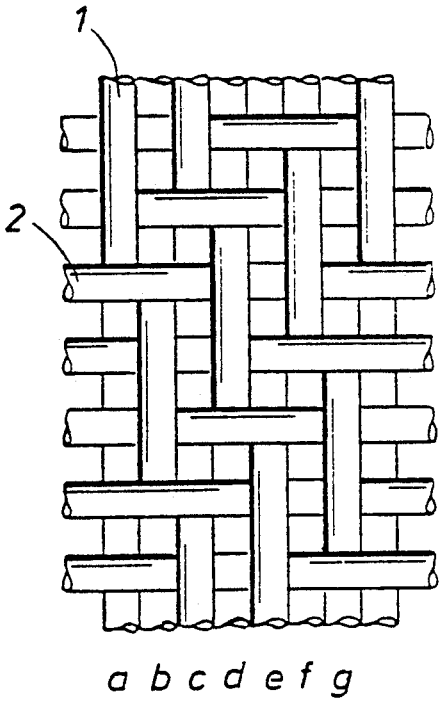
FIG. 1 is a plane view of the paper forming side of a known double layered paper making forming fabric or wire having seven shafts weave (weave pattern repeat number 7)
Figure 1A:
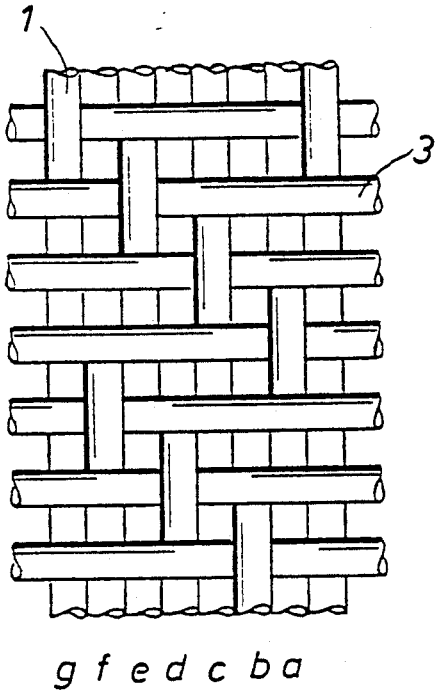
FIG.1*a* is a plane view of the running side or the wearing side of the forming fabric of FIG. 1.
Figure 5:
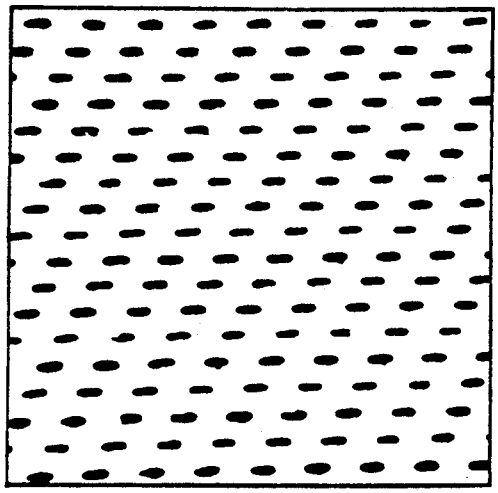
FIG. 5 is an impression of the running side of a known forming fabric having 7 shafts, magnified 6.5 times
Figure 6:
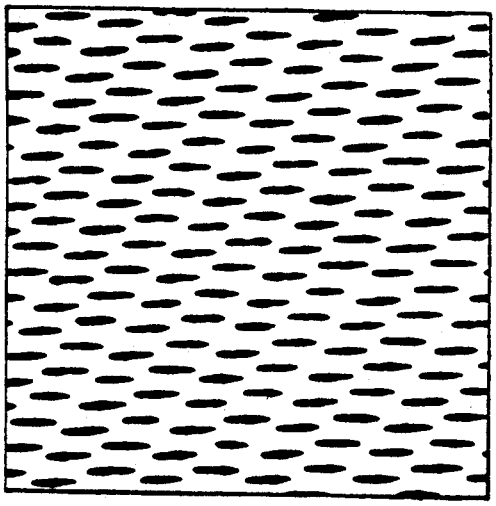
FIG. 6 is an impression of the running side of a forming fabric according to the invention provided with twin threads, the interlacing and fineness correspondent to those ones of the forming fabric of FIG.5.

For clarifying the differences of the wear volume of the fabric according to the invention in comparison to a known forming fabric shown in FIG.1, an impression of the running side of a fabric with twin threads according to the invention is shown in FIG. 6, in which the binding and fineness correspond to the fabric shown in FIG. 5 also as an impression of the running side. That impression shows a known 7-shaft fabric magnified 6.5 times.

The cross or twin threads, which are indicated by reference numerals 4*a* and 4*b*, form a pair of cross threads 4.

We claim:

1. Double layered paper making forming fabric with a coarse structured running side and a fine structured paper side, comprising a single longitudinal thread set and at least two cross thread sets which are interwoven in a weave pattern repeat of at least six shafts, so that one of said at least two cross thread sets forms on the running side a wearing plane and the remaining cross thread set or sets are arranged on the paper side, and wherein at least some of the cross threads on the running side form multiple cross thread sets, each of said multiple cross thread sets consisting of at least two closely adjacent threads, which are more closely adjacent to each other than to the threads of the next adjacent multiple cross thread set, with each one of said threads of each multiple cross thread set being interlaced by different spaced longitudinal threads with non interlacing longitudinal threads therebetween.

2. Double layered paper making forming fabric according to claim 1, characterized in that the multiple cross thread sets form thread twins.

3. Double layered paper making forming fabric according to claim 2, characterized in that the individual threads of the multiple cross thread sets contact at least partly one another.

4. Double layered paper making forming fabric according to claim 1, characterized in that the individual threads of the multiple cross thread sets contact at least partly one another.

5. Double layered paper making forming fabric according to claim 1, characterized in that each of said multiple cross thread sets consists of a pair of threads and the interlacing of a given cross thread set is separated by longitudinal threads with respect to the next adjacent interlacing of said given cross thread set by n/2 longitudinal threads, wherein "n" is the number of the weave pattern repeat.

6. Double layered paper making forming fabric according to claim 5, characterized in that the two longitudinal threads, each of which is interlaced with one of the two threads of said pair of threads, are interwoven with the remaining cross threads in the weave pattern at the same place in an adjacent pattern repeat.

7. Double layered paper making forming fabric according to claim 1, characterized in that said at least two cross thread sets comprise two cross thread sets on the paper side, and a third cross thread set on the running side which differs with respect to the length of its floatings from the length of the floatings of the two cross thread sets on the paper side.

8. A double layered paper making forming fabric according to claim 1, characterized in that said at least two cross thread sets comprise two cross thread sets on the paper side, the material and/or diameter of which may be the same or may be different.

9. Double layered paper making forming fabric according to claim 1, characterized in that the individual threads forming each of said multiple cross thread sets differ from each other with respect to material.

10. Double layered paper making forming fabric according to claim 1, characterized in that the individual threads forming each of said multiple cross thread sets differ from each other with respect to diameter.

* * * * *